US009289767B2

(12) United States Patent
Taunk

(10) Patent No.: US 9,289,767 B2
(45) Date of Patent: Mar. 22, 2016

(54) MICROTUBE CAP

(71) Applicant: Dale Singh Taunk, Fremont, CA (US)

(72) Inventor: Dale Singh Taunk, Fremont, CA (US)

(73) Assignee: AlphaGem Bio Inc., Newark, CA (US)

( * ) Notice: Subject to any disclaimer, the term of this patent is extended or adjusted under 35 U.S.C. 154(b) by 0 days.

(21) Appl. No.: 13/798,078

(22) Filed: Mar. 13, 2013

(65) Prior Publication Data

US 2014/0271408 A1 Sep. 18, 2014

(51) Int. Cl.
*B01L 3/00* (2006.01)
*B01L 7/00* (2006.01)

(52) U.S. Cl.
CPC ..... *B01L 3/50825* (2013.01); *B01L 3/50851* (2013.01); *B01L 3/50853* (2013.01); *B01L 7/52* (2013.01); *B01L 2200/0689* (2013.01); *B01L 2300/042* (2013.01); *B01L 2300/043* (2013.01); *B01L 2300/0654* (2013.01)

(58) Field of Classification Search
USPC ..... 422/55
See application file for complete search history.

(56) References Cited

U.S. PATENT DOCUMENTS 4,674,640 A * 6/1987 Asa et al. ..... 215/230
5,753,186 A * 5/1998 Hanley et al. ..... 422/550
6,136,273 A * 10/2000 Seguin ..... B01L 3/50853 206/443
2002/0187077 A1* 12/2002 Berray ..... B01L 3/50853 422/569
2004/0086927 A1* 5/2004 Atwood et al. ..... 435/6
2004/0234422 A1* 11/2004 Belz ..... B01L 3/50851 435/288.1
2004/0258563 A1* 12/2004 Young et al. ..... 422/58
2007/0102393 A1* 5/2007 Colin ..... B01L 3/50825 215/249
2008/0257882 A1* 10/2008 Turner ..... 220/23.2

OTHER PUBLICATIONS

Merriam Webster Online Dictionary. Concave (Synonyms) http://www.merriam-webster.com/dictionary/concave. Accessed on Feb. 12, 2014.*
https://web.archive.org/web/20110815122748/http:/www.bioplastics.com/downloads/100607_B77201_B72811.pdf published Aug. 15, 2011.*
http://web.archive.org/web/20100427072035/http://www.bioplastics.com/catalog/ts_Click_on_cap_strips.aspx published Apr. 27, 2010.*
http://web.archive.org/web/20100427072344/http://www.bioplastics.com/catalog/ts_general_info.aspx published Apr. 27, 2010.*

* cited by examiner

*Primary Examiner* — Jill Warden
*Assistant Examiner* — Benjamin Whatley
(74) *Attorney, Agent, or Firm* — Geeta Kadambi; Riddhi IP LLC

(57) ABSTRACT

A microtube with a novel recessed concave top is described. The recessed top is at least 20-80% of the area of the entire cap and has a thickness from 0.025 mm to 1.0 mm. The recessed portion is smooth in structure and is optically transparent to allow all instrumental reading based on optical value reliable and accurate. The cap also has a unique plug design that has two parts. One part is the lower part that is a bit broader than the upper part. The upper part is a bit smaller than the opening. This structure allows the microtube maintain the structure and prevents the liquid from coming out when the microtube undergoes lab conditions such as heating, cooling, spinning, and boiling. The microtube holds a volume of about 0.01 ul to 1.00 ml of liquid.

19 Claims, 8 Drawing Sheets

MICROTUBE CAP

FIELD OF INVENTION

The present invention is generally directed to a microtube cap for more accurate reading of the results of polymerized chain reaction products and others.

BACKGROUND

During research and diagnostics testing process of real-time polymerized chain reaction (PCR) products the analyzer instrument uses a light source to gather data during the PCR amplification process. This process uses products such as single tubes and caps, strips tubes and caps (typically 8 or 12 inline format) and grid format plates (8×12, 16×24 etc.). Prior to the actual testing process the sample have to be prepared. The sample preparation involves filling the tubes with an assay reagents and sealing the tubes to prevent evaporation during the thermal cycling. With the current designs of products available in the market for real-time PCR the lens of the sealing caps, strips and films come directly in contact with hands, thumbs, fingers or automated sealing devices and adversely effects the surface of the lens for optical clarity. Direct contact of this type is not desirable.

For manual application of real-time PCR microtube caps a researcher will typically align the caps, strips or films and body of the PCR tubes and apply 1 to 3 pounds of pressure on top of caps with their hands, thumbs and finger or other device. This also changes the shape of the top surface that would be subsequently used for optical measurement.

In automated capping and sealing film machines the sealing platform applies direct pressure and or heat to the lens area of the PCR caps strips and films directly contacting the lens area. This direct contact to the lens area through which light will pass and be used to gather the PCR reaction data is not desirable for the many reasons. There is a need for producing a more optically conducive microtube cap.

SUMMARY

The present invention is an improvement on the existing microtube cap. In one embodiment, the product as a microtube has a closed distal end and an open proximal end. The proximal end is attached to a hinge that connects the proximal end and the cap. In another embodiment, the cap is a spherical shaped lid for the proximal open end of the tube. It has various indentations as concentric rings. The outer ring is wider than the inner first ring and extends over the opening of the proximal end of the tube. The inner first ring encloses the opening of the proximal end of the tube. The inner second ring is lower than the inner first ring. The inner second ring is concave in shape.

In one embodiment, the surface of the inner second ring is made up of a transparent material of different thickness. The outer first ring has an inward protrusion called a plug that extends downwards and snugly closes the inner walls of the proximal end.

The product (microtube) can hold between 0.01 ul to 1.00 ml content. The product may be made of polypropylene, polycarbonate, cyclic olefin copolymer material.

The instant product may be used for regular PCR or real-time PCR. In another embodiment, clear inner second ring that is recessed is used for accurate optical reading. In another embodiment, recessed inner second ring to prevent glove or hand touch smudges that interfere with optical reading, avoids scratched due to close packing, PCR plate depression due to heat, avoids contact while processing.

The configuration of the microtube may be in the format of individual tube, eight tube strip, 96 well format tube, 8 strip cap, 8×12 grid microtube or plate cap with the lowered feature and a flat sealing film with 96 lowered cap to fit a 96 well plate.

The product and method of using the product disclosed herein may be implemented in any means for achieving various aspects. Other features will be apparent from the accompanying drawings and from the detailed description that follows.

BRIEF DESCRIPTION OF THE DRAWINGS

Example embodiments are illustrated by way of example and not limitation in the figures of the accompanying drawings, in which like references indicate similar elements and in which.

Other features of the present embodiments will be apparent from accompanying the detailed description that follows.

DETAILED DESCRIPTION

Figure 1:
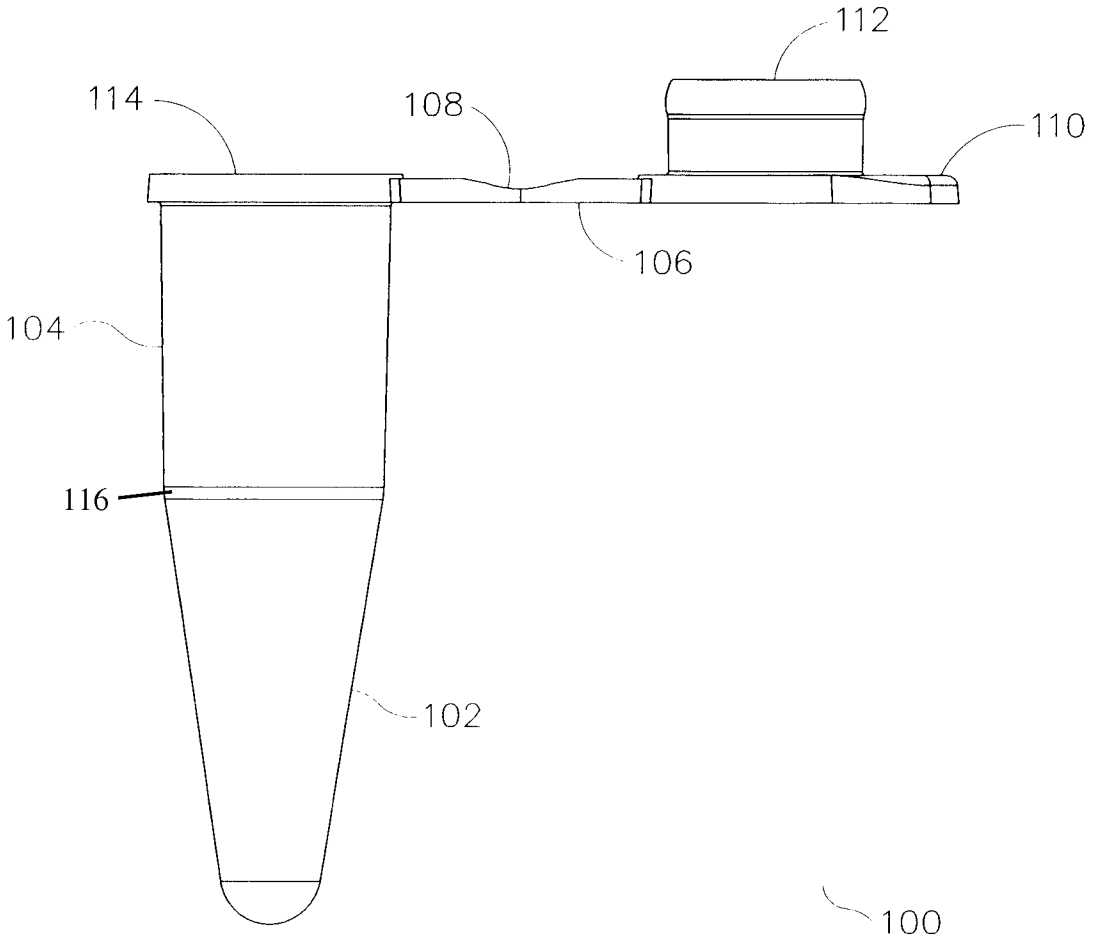
FIG. 1 is a front view of the microtube 100.

The present invention is directed to a microtube product that has a special structural change at the cap. This cap design may be applied to other formats such as strip or grid formats. More specifically the change in the design of the cap enables the optical reading to be more accurate. In one embodiment, the microtube has a distal end and a proximal end. FIG. 1 shows the front view of the microtube 100. The microtube 100 has a distal end 102 and a proximal end 104. The distal end 102 is conical at the bottom which is closed and wider on the top that is open. The proximal end 104 has an opening 114 to house the inward protrusion called plug 112 to seal the microtube. The proximal end has a ridge like structure 116 that strengthens the opening structure and allows the microtube to withstand the process depended effects such as heating, cooling, boiling, centrifugation and storing.

During the manufacturing process, transit and use, the PCR caps and films are packaged in hundreds or sometimes thousands in a plastic bag allowing them to rub and chafe causing the lens area to have possible blemishes. In the new designs, the lowered and better protected lens area is more likely to be protected against surface imperfections resulting is more consistent testing data.

The new and improved cap, strip and film lens design is recessed into the caps avoiding the direct contact during the cap application in both manual and semi and automated processes. This key feature has many advantages as follows.

- Avoid direct contact with lens during cap application as the lens area is lower than cap that will take the pressure to apply it to the tubes.
- Optimal optical reading due to lack of smudge, scratch or stains.

The product also has consistent wall thickness that enables uniform heating and cooling for accurate results. The polished inner surface and distal conical bottom allows maximum sample recovery. A hinge 106 like structure connects the opening of the proximal end and the cap 110. The hinge 106 has a flexible structure 108 that allows the hinge to be folded to allow the cap to close the opening of the proximal end of the microtube. The cap has an overextended radius and blended structure 110 that helps close the cap and also open the cap without touching the inner second ring with finger.

Figure 2:
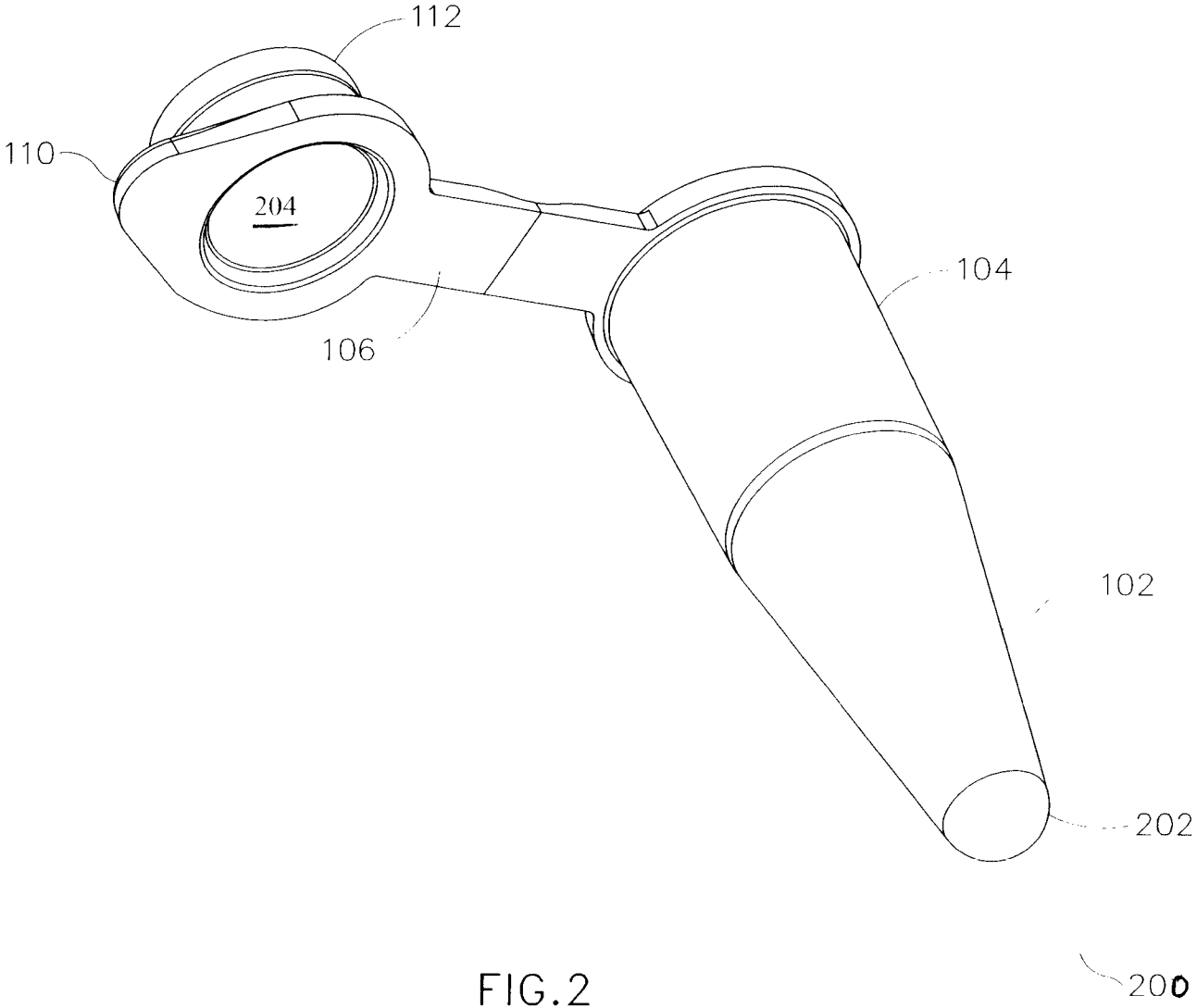
FIG. 2 is a bottom back view 200 of the microtube 100.

FIG. 2 shows bottom back view 200 of the microtube 100. The conical end 202 for the distal end is clearly visible in this angle and shows that it is directly in line with the opening of the proximal end. The inner second ring 204 of the cap is shown as a recessed section in this view. It may be concave, flat or rounded and is lower than the inner first ring. The recessed second ring 204 of the cap depressed and prevents the user from touching it while performing experiments. It is also made up clear materials that are biologically inactive but optically provides a clear path for passing through to read the samples in the conical end 202. The conical end 202 accommodates very small amount of samples and helps perform experiments in smaller quantities. The concave recessed part is transparent to allow maximum optical clarity for measuring the concentration of a sample after a real-time polymerase chain reaction. The concave recessed part 204 is at least 20-80% of the cap surface and has a thickness from 0.025 mm to 1.0 mm.

Figure 3:
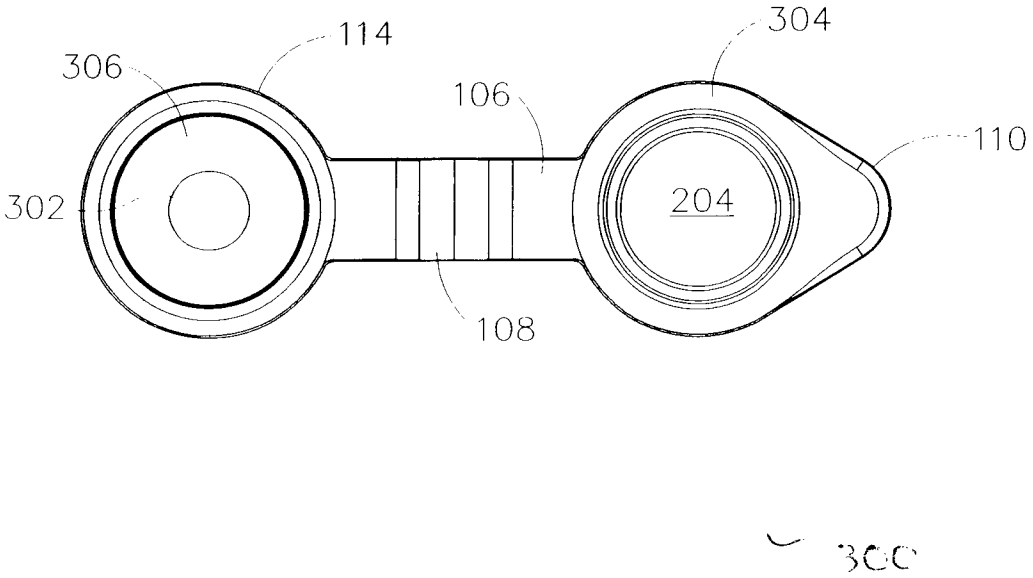
FIG. 3 is a top view 300 of the microtube 100.

FIG. 3 shows top view 300 of the microtube 100. The conical end is shown as a narrow bottom 302. It also depicts how centrally it is situated and is covered very well by 204. The outer ridge shown as 304 is wider than the proximal end 104 and covers the entire open end of the proximal end. The inner ring of the ridge of the proximal open end 306 is shown to be made up of a stronger material. This allows the tube (used interchangeably with microtube) from getting destroyed while regular lab use such as boiling, heating and cooling.

Figure 4:
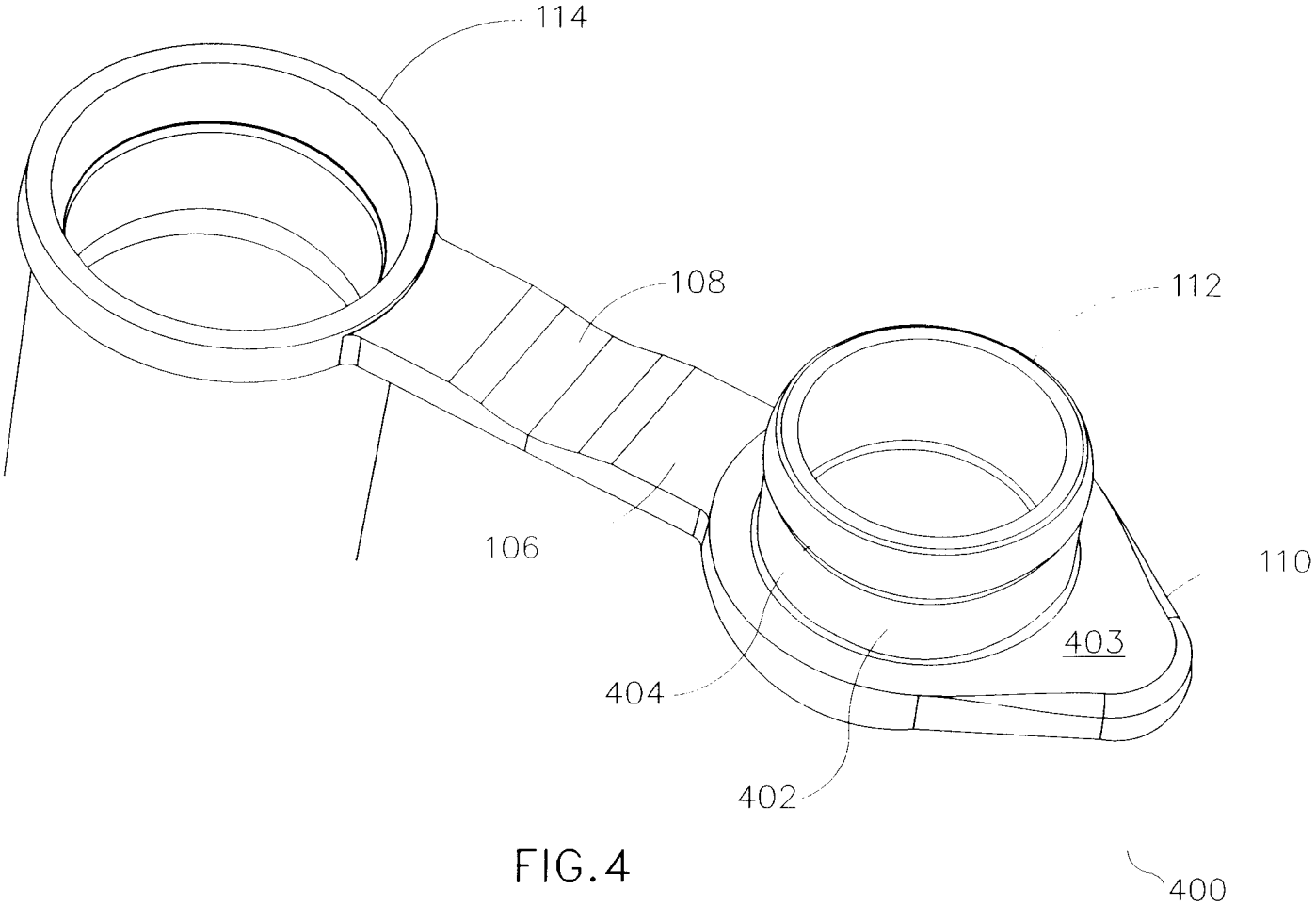
FIG. 4 is the close up bottom view 400 of the cap for the microtube 100.

FIG. 4 shows the close up bottom view 400 of the cap for the microtube 100. A plug 112 is used to be housed in the opening of the proximal end to secure the content of the microtube. It has two flanges. The wider end of the flange 404 is equal to the circumference of the proximal part of the microtube and top end of the flange 402 has the same circumference to fit the opening of the top of the proximal end. This is a novel approach to make sure there is minimal loss of material and no evaporation of samples while in use. The tip of the cap 404 may be used for opening and closing the tube as well.

Figure 5:
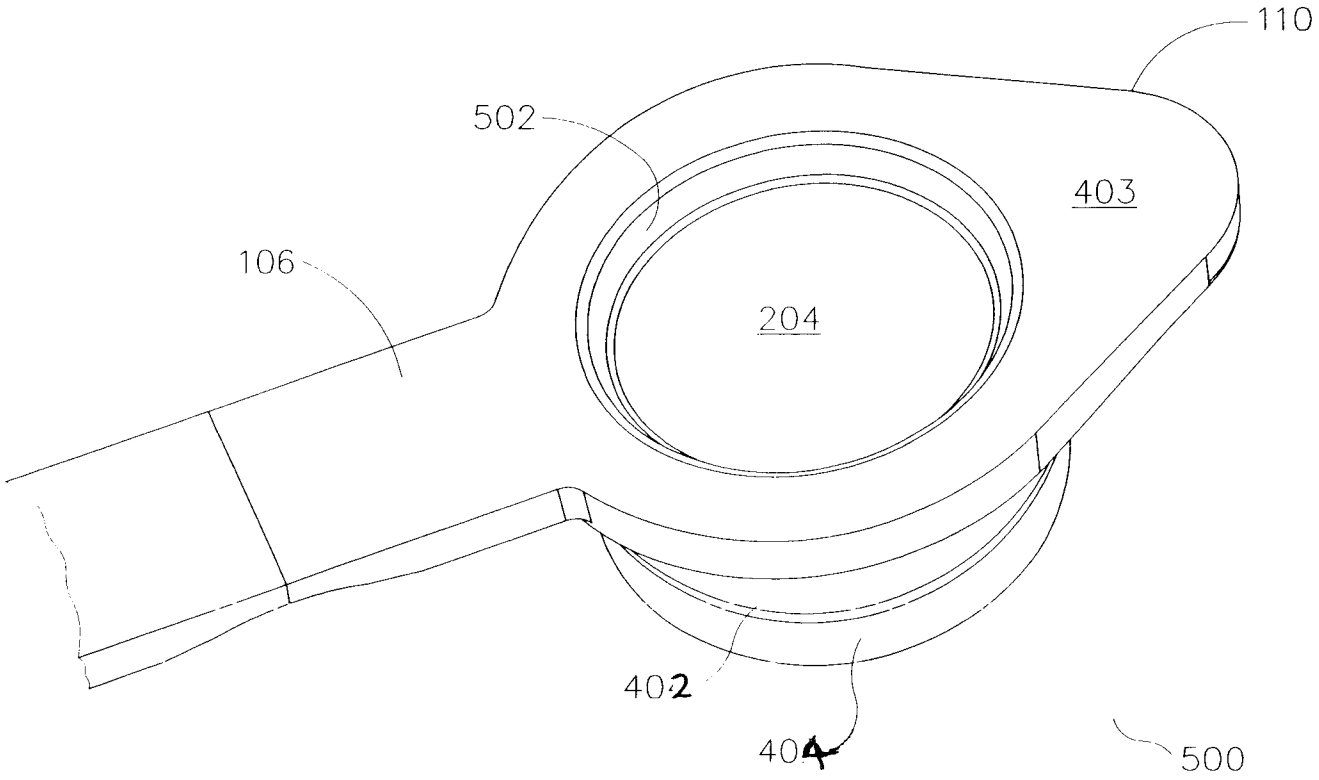
FIG. 5 is the close up top view 500 of the cap for the microtube 100.

FIG. 5 is the close up top view 500 of the cap for the microtube 100. It shows in detail the upper portion of the inner second ring 204 recessed cap. The ridge that surrounds and connects the recessed part to the inner first ring 502 is shown to have a shape. It could be flat, concave or smooth. This provides the means for lowering the inner second ring 204 to be lower than inner first ring.

Figure 6:
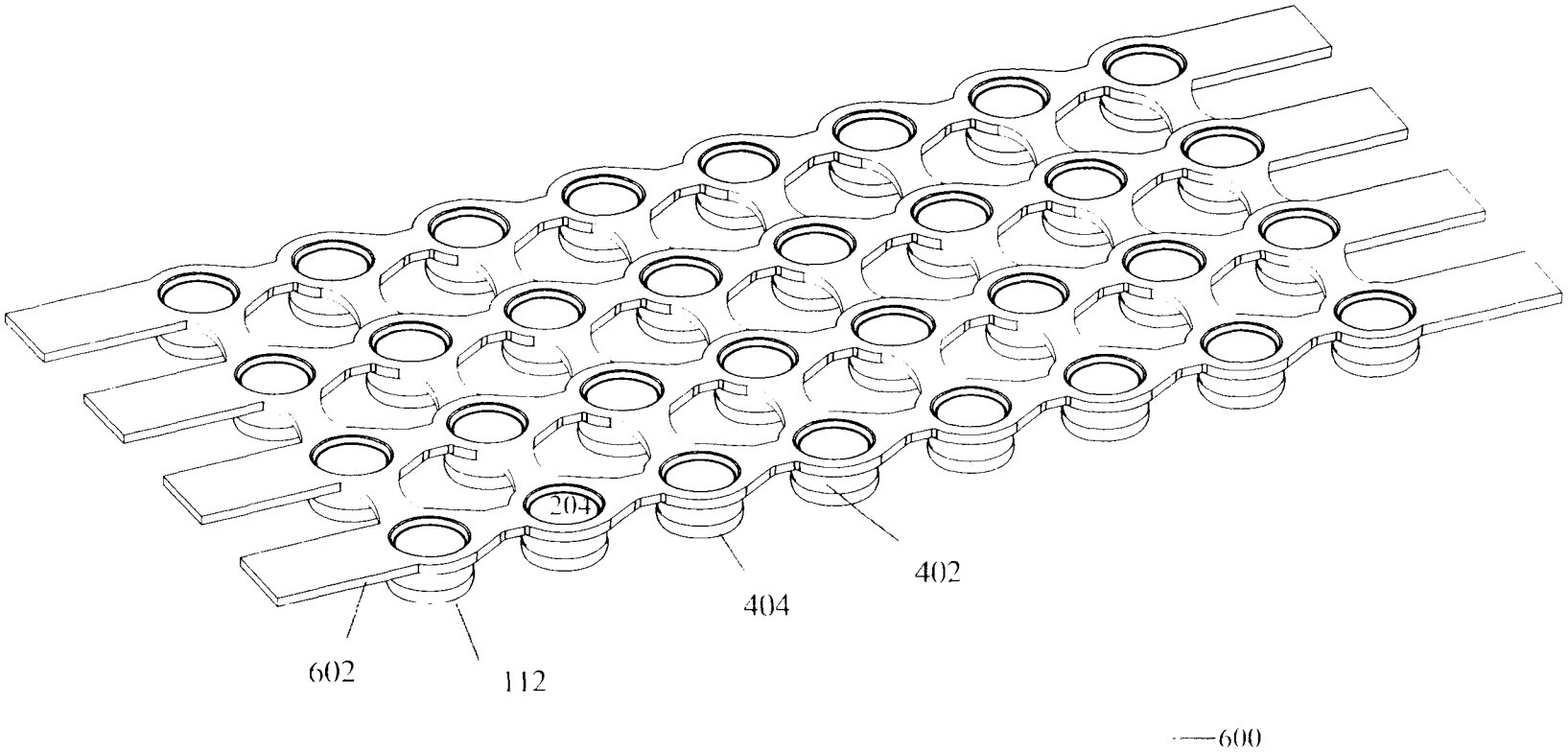
FIG. 6 shows a plate cap 600.

FIG. 6 shows a plate cap 600. The plate cap may be in form of films, strips or individual caps. The figure shows a composition of 8×4 strips that may be used on a limited number of microtubes or a partial PCR plate. The novel feature inner second ring 204 is present in the shown embodiment. The extra extension 602 allows the user to hold the strip before loading in on to the microtube or plate.

Figure 7:
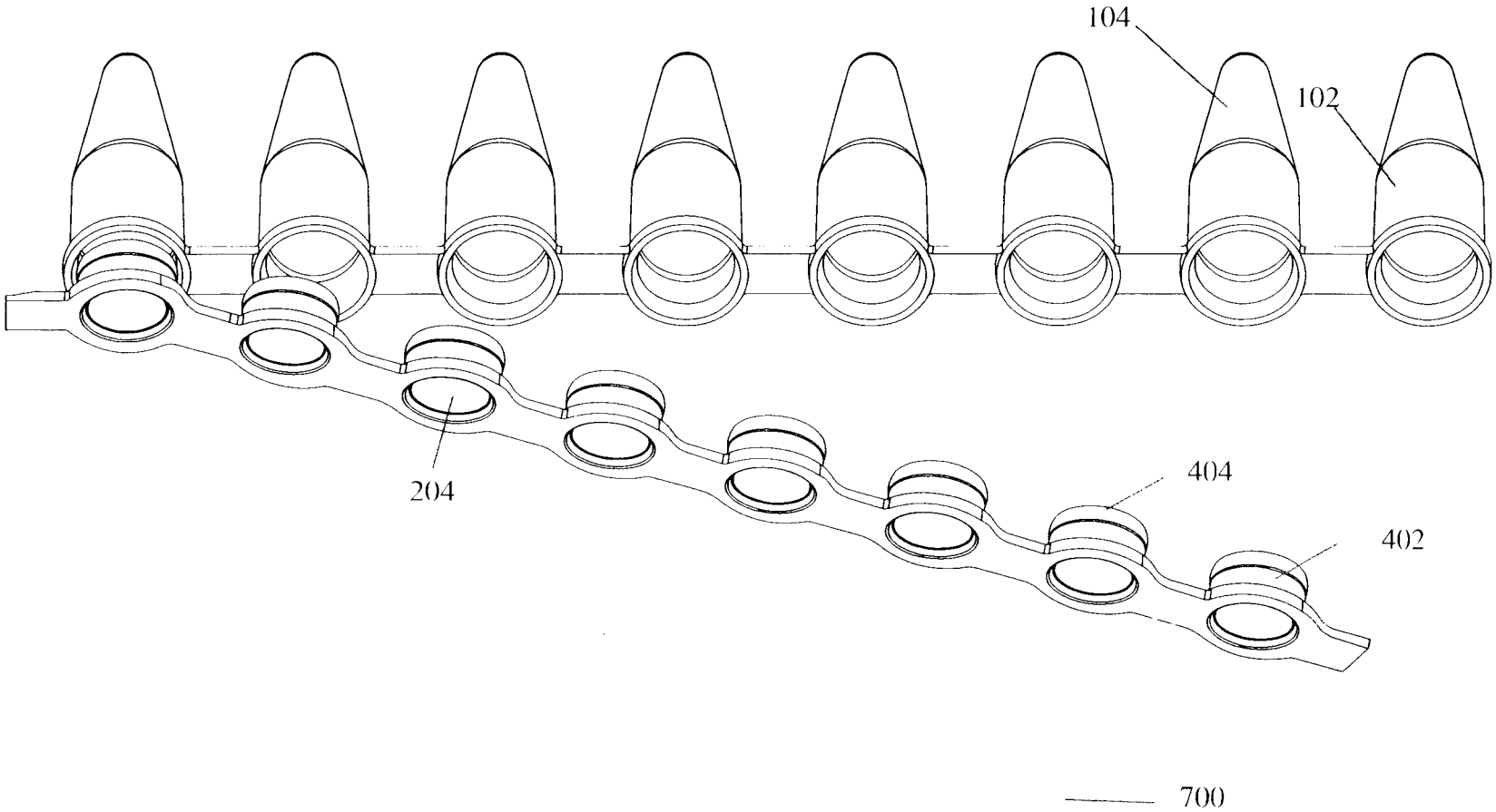
FIG. 7 shows a single 8 microtube cap strip 700 for microtube 100.

FIG. 7 shows a single 8 microtube cap strip 700 for microtube 100. The strip of tubes may be secured using this embodiment. The novel feature inner second ring 204 is shown to exist in this configuration and helps secure and stop cross contamination of the samples as well.

Figure 8:
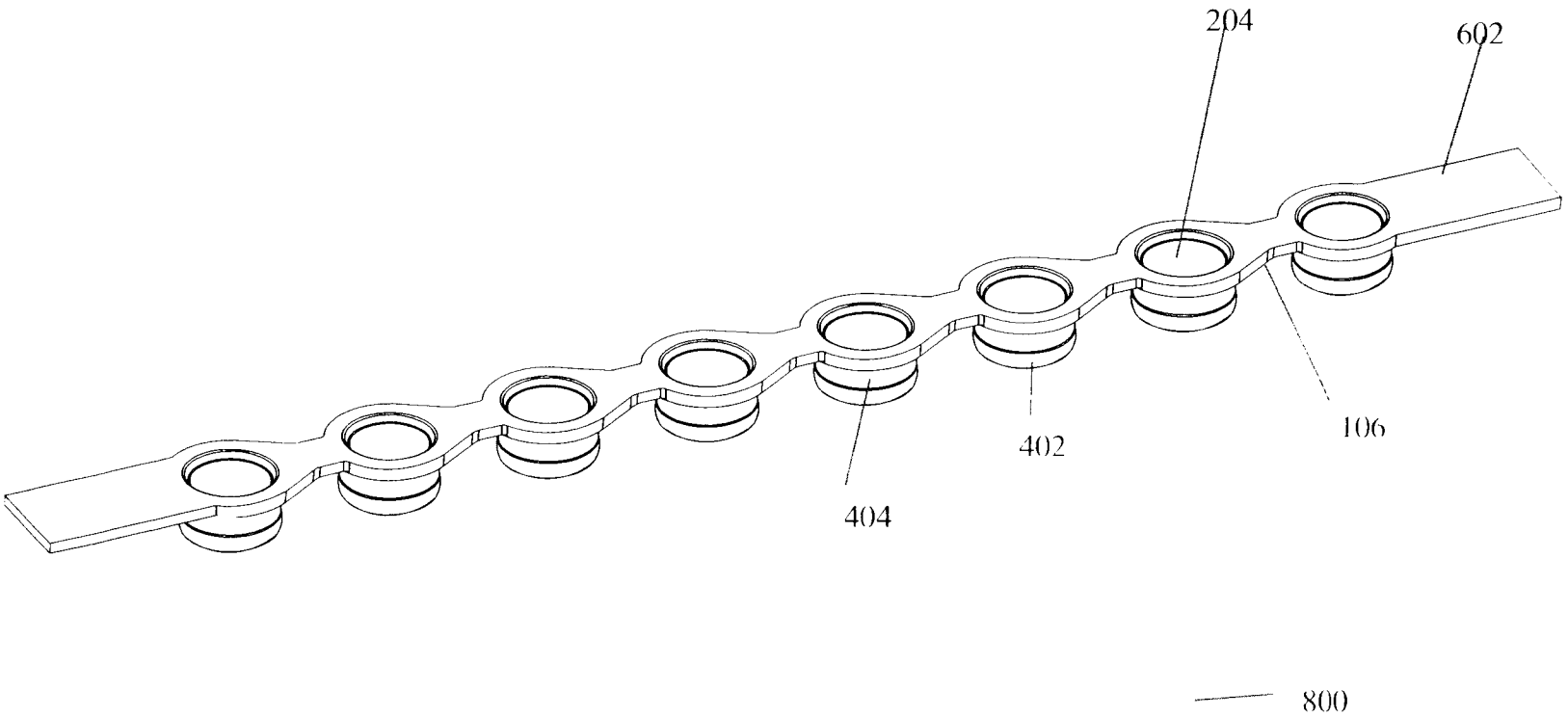
FIG. 8 shows a single 8 microtube cap strip 800 for a plate or microtube 100.

FIG. 8 shows a single 8 microtube cap strip 800 for a plate or microtube 100. This embodiment may also be used as a film. The hinge 106 may be made so that they can be broken off and each cap may be used individually.

In addition, it will be appreciated that the various embodiments, materials, and compositions can be interchangeable used in the current embodiments and various combinations of the article of use. Accordingly, the specification and drawings are to be regarded in an illustrative rather than a restrictive sense.

What is claimed is:

1. A microtube and a cap, comprising:

a distal end with a closed conical bottom which holds no more than 0.01 ul-0.50 ml in volume in the microtube;

a proximal end having an opening to house a plug of the cap;

the cap having the plug and a tip for opening and closing the tube;

an inner second ring of the cap which has a concave shape on the upper side and is depressed lower than an inner first ring on the cap to allow an optical intensity to be read accurately and covers at least 20-80% of the cap surface, and has a thickness from 0.25 mm to 0.9 mm; and the concave shaped surface of the inner second ring is made of an optically clear material.

2. The microtube and the cap of claim 1, wherein the plug has a wider end of a flange towards the end of the cap and a top end of the flange away from the end of the cap to secure the contents of the microtube.

3. The microtube and the cap of claim 2, wherein the wider end of the flange is equal to the circumference of the proximal part of the microtube.

4. The microtube and a cap of claim 1, further comprising;

wherein the inner second ring of the cap has the concave surface which is centrally aligned with the center of the closed conical bottom.

5. The microtube and a cap of claim 1, further comprising;

a hinge connecting the proximal end of the microtube and the cap; and a flexible center on the hinge that allows the hinge to be folded to allow the cap to close the opening of the proximal end of the microtube.

6. A microtube and a cap, comprising:

a tubular structure having a distal end and a proximal end, wherein the proximal end is wider than the distal end, wherein the distal end holds no more than 0.01 ul-0.50 ml in volume in the microtube;

the cap to close the proximal end, wherein the cap has two rings, an inner first ring and an inner second ring depressed lower than the inner first ring, wherein the inner second ring has a concave recessed part in the center for optical clarity and the cap is made up of an optically clear material, wherein the concave recessed part has a thickness from 0.28 mm to 0.9 mm and is at least 20-80% of the cap surface; and a hinge that connects the tubular structure and the cap so that the cap is secure and easy to operate.

7. The microtube and a cap of claim 6, wherein the distal end is conical at one end to accommodate a sample.

8. The microtube and a cap of claim 6, wherein the concave recessed part is transparent to allow optical clarity for measuring the concentration of a sample after a real-time polymerase chain reaction/qPCR.

9. The microtube and a cap of claim 8, wherein the concave recessed part is directly above a conical part of the distal end.

10. The microtube and a cap of claim 6, further comprising:

a flexible part on the hinge between the cap and the proximal end of the microtube.

11. A microtube and a cap, comprising:

the cap having an inner first ring and an inner second ring that are concentric to each other and the inner second ring is recessed with respect to the inner first ring and has a concave portion, wherein the inner second ring is optically clear and is at least 20-80% of the cap surface and has a thickness from 0.25 mm to 0.9 mm; and a tubular structure having a distal end and a proximal end, wherein the proximal end is wider than the distal end, wherein the distal end has a closed conical end and holds no more than 0.01 ul-0.50 ml in volume in the microtube.

12. The microtube and the cap of claim 11, wherein the microtube is made up of at least one of the following polypropylene, polycarbonate, or cyclic olefin copolymer material.

13. The microtube and the cap of claim 11, wherein the closed conical end of the microtube and the inner second ring of the cap are directly in line with each other.

14. The microtube and the cap of claim 11, further comprising:

a plug on the cap used to be housed in the opening of the proximal end to secure the content of the microtube.

15. The microtube and the cap of claim 11, wherein the volume is 0.2 ml.

16. A plurality of microtubes and a strip cap array, comprising:

a plurality of distal ends with closed conical bottoms which hold no more than 0.01 ul-0.5 ml in volume in each of the plurality of microtubes;

a plurality of proximal ends, each having an opening to house a plug of a respective cap in the strip cap array;

each cap in the strip cap array having the plug and a tip for opening and closing the respective tube;

each cap having an inner second ring with a concave shape on the upper side where the inner second ring is depressed lower than an inner first ring on the cap to allow an optical intensity to be read accurately, wherein the inner second ring covers at least 20-80% of the cap surface, and has a thickness from 0.25 mm to 0.9 mm; and the concave shaped surface of the inner second ring is made of an optically clear material.

17. A multi-well microplate and a strip cap array, comprising:

a plurality of distal ends with closed conical bottoms which hold no more than 0.01 ul-0.5 ml in volume in each of the plurality of wells;

a plurality of proximal ends, each having an opening to house a plug of a respective cap in the strip cap array;

each cap in the strip cap array having the plug and a tip for opening and closing the respective well;

each cap having an inner second ring with a concave shape on the upper side where the inner second ring is depressed lower than an inner first ring on the cap to allow an optical intensity to be read accurately, wherein the inner second ring covers at least 20-80% of the cap surface, and has a thickness from 0.25 mm to 0.9 mm; and the concave shaped surface of the inner second ring is made of an optically clear material.

18. A multi-well microplate and a grid cap array, comprising:

a plurality of distal ends with closed conical bottoms which hold no more than 0.01 ul-0.5 ml in volume in each of the plurality of wells;

a plurality of proximal ends, each having an opening to house a plug of a respective cap in the grid cap array;

each cap in the grid cap array having the plug and a tip for opening and closing the respective well;

each cap having an inner second ring with a concave shape on the upper side where the inner second ring is depressed lower than an inner first ring on the cap to allow an optical intensity to be read accurately, wherein the inner second ring covers at least 20-80% of the cap surface, and has a thickness from 0.25 mm to 0.9 mm;

the concave shaped surface of the inner second ring is made of an optically clear material; and wherein the grid cap array is defined an 8×12 or 8×4 array of caps.

19. A process for performing real-time PCR/qPCR experiments, the process comprising:

providing the device as claimed in claim 1, 6, 11, 16, 17 or 18; and performing real-time PCR/qPCR.

* * * * *